US006840692B2

(12) United States Patent
Ward et al.

(10) Patent No.: US 6,840,692 B2
(45) Date of Patent: Jan. 11, 2005

(54) METHOD AND APPARATUS FOR MAKING NIBS AND INK RESERVOIRS FOR WRITING AND MARKING INSTRUMENTS AND THE RESULTANT PRODUCTS

(75) Inventors: Bennett C. Ward, Midlothian, VA (US); Robert D. Long, Chester, VA (US); Donald F. Nelson, Richmond, VA (US); Raymond J. Nelson, Powhattan, VA (US); Jackie F. Payne, Jr., Chester, VA (US); E. Vaughan Yancey, Manakin Sabot, VA (US)

(73) Assignee: Filtrona Richmond, Inc., Colonial Heights, VA (US)

( * ) Notice: Subject to any disclaimer, the term of this patent is extended or adjusted under 35 U.S.C. 154(b) by 0 days.

(21) Appl. No.: 10/391,007

(22) Filed: Mar. 19, 2003

(65) Prior Publication Data

US 2003/0194260 A1 Oct. 16, 2003

Related U.S. Application Data

(60) Provisional application No. 60/371,154, filed on Apr. 10, 2002.

(51) Int. Cl.[7] ..... B43K 5/00

(52) U.S. Cl. ..... 401/199; 401/198

(58) Field of Search ..... 401/171, 178, 401/223, 224; 428/365, 369, 373, 374, 903

(56) References Cited

U.S. PATENT DOCUMENTS

| | | | | |
|---|---|---|---|---|
| 4,221,493 A | * | 9/1980 | Cole et al. | 401/199 |
| 5,445,884 A | | 8/1995 | Hoyt et al. | 428/370 |
| 5,607,766 A | | 3/1997 | Berger | 428/373 |
| 5,633,082 A | | 5/1997 | Berger et al. | 428/365 |

OTHER PUBLICATIONS

International Search Report corresponding to PCT/US03/08392 mailed on Jul. 15, 2003.

* cited by examiner

*Primary Examiner*—David J. Walczak
(74) *Attorney, Agent, or Firm*—Hunton & Williams LLP

(57) ABSTRACT

Melt blown bicomponent fibers comprising a sheath of polyethylene terephthalate or a copolymer thereof and a core of nylon 6,6 and a reservoir or a nib in a writing or marking instrument comprising a porous element formed from such fibers bonded to each other at spaced points of contact. For use as a nib the core polymer may also be polybutylene terephthalate.

6 Claims, 2 Drawing Sheets

51

50
55
51
52

60

METHOD AND APPARATUS FOR MAKING NIBS AND INK RESERVOIRS FOR WRITING AND MARKING INSTRUMENTS AND THE RESULTANT PRODUCTS

This is a complete application claiming benefit of provisional application Ser. No. 60/371,154 filed Apr. 10, 2002.

BACKGROUND OF THE INVENTION

1. Technical Field

The instant invention relates to unique polymeric bicomponent fibers and to the production of wicking devices, especially, nibs and ink reservoirs for writing and marking instruments made from such fibers. More specifically, this invention is directed to the production and use of nibs and ink reservoirs, particularly nibs for writing and marking instruments such as fiber tip pens and "felt tip" markers, as well as roller ball wicks for roller ball pens, wherein the wicking devices are formed of sheath-core, melt blown, bicomponent fibers wherein a core of a nylon 6,6 is substantially fully covered with a sheath of polyethylene terephthalate or a copolymer thereof. For the production of nibs, the core material may be polybutylene terephthalate.

2. Discussion of the Prior Art

The production of thermally bonded fibrous products for various applications is disclosed in commonly assigned U.S. Pat. No. 5,607,766 issued Mar. 4, 1997 (the subject matter of which is incorporated herein in its entirety by reference) (the '766 patent) using bicomponent fibers comprising a coating of a polyester sheath, such as polyethylene terephthalate and its copolymers, over a thermoplastic core, such as polypropylene and polybutylene terephthalate. There are currently commercial permanent ink markers using nibs made of polyester felt impregnated with phenolic resin which have an aggressive xylene-based ink formulation. Past attempts to produce nibs formed of bonded polyester fiber tows, particularly for use with writing and marking instruments incorporating such aggressive inks, have suffered unacceptable "drainback" properties. A drainback test is where the marker is stood on end, tip up, for 48 hours. It is then inverted (tip down). The pen must write on the third stroke to pass the test. While currently available polyester felt/phenolic nibs satisfy commercial drainback criteria, early polyester filament-based attempts to reproduce these properties failed.

Although core materials of polybutylene terephthalate, as disclosed in the '766 patent, show desirable properties for use as reservoirs in writing and marking instruments and the polyester/polypropylene bicomponent fiber products discussed therein are acceptable for selected applications, both polypropylene and nylon 6 core materials in polyester sheath bicomponent fiber thermally bonded writing and marking instrument components have now been found to unduly soften in the presence of certain particularly aggressive ink formulations, making marking and writing instrument components, particularly nibs, formed of bicomponent fibers having polyester sheaths with such core polymers of limited utility and, from a commercial standpoint, effectively useless.

This invention relates to the surprising discovery that, in the production of nibs for writing instruments, such as roller ball or fiber-point pens, or marking instruments, such as felt-tipped permanent highlighters, dry-erase markers and the like, especially those incorporating aggressive inks such as xylene-based permanent ink formulations, the use of a bonded fibrous element formed from melt blown bicomponent fibers comprising a polyester sheath and a nylon 6,6 or polybutylene terephthalate core material provides excellent drainback and ink laydown properties, thermal stability and physical robustness. Use of bonded fiber tow materials, even bicomponent fiber tows having a polyester sheath over a nylon 6,6 core, will fail the drainback test, but melt blown bicomponent fibers of these polymers produce acceptable nibs for writing and marking instruments.

Such products also have unexpectedly improved solvent resistance and increased stiffness avoiding degradation under pressure in use. Moreover, these unique bicomponent fibers produces writing and marking instrument components which are less expensive than competitive products, such as the polyester felt/phenolic nibs currently in the market. Similar advantages are expected for ink reservoirs formed of melt blown polyester/nylon 6,6 bicomponent fibers.

OBJECTS AND SUMMARY OF THE INVENTION

It is, therefore, a principal object of the instant invention to provide a method and apparatus for making writing and marking instrument components in a simple, efficient and inexpensive manner, yet having the property of unexpectedly improved drainback, exceptional solvent resistance in the presence of highly aggressive ink formulations, and increased stiffness and robustness, resisting degradation under pressure, particularly when used as a nib.

Another object of this invention is the provision of melt blown polymeric bicomponent fibers having a polyester sheath, particularly polyethylene terephthalate and copolymers thereof, totally surrounding a core of nylon 6,6, and the production of thermally bonded porous fibrous products for use as a nib, roller ball wick or ink reservoir in a writing or marking instrument which will not be significantly softened by the solvent in the ink and function effectively to retain and controllably feed ink from a reservoir to a writing surface even after extended use.

Yet another object of this invention is the provision of a writing instrument and/or a marker incorporating a nib, roller ball wick and/or an ink reservoir formed as a thermally stable, three-dimensional, porous element capable of storing and/or controllably releasing and feeding a liquid ink formulation with little or no drainback.

A further object of this invention is the provision of a high capacity ink reservoir for a writing or marking instrument defined by an elongated porous rod formed of a network of fine melt blown bicomponent fibers having a continuous sheath of polyethylene terephthalate or a copolymer thereof, and a core of nylon 6,6, and a nib for a roller ball or fiber-point pen or a felt-tipped marker, or the like, which are compatible with all currently-available ink formulations and provide an adequate release pressure to minimize "leakers" and "drainback", and remain functionally effective over extended periods of use.

Upon further study of the specification and the appended claims, additional objects and advantages of this invention will become apparent to those skilled in the art.

BRIEF DESCRIPTION OF THE DRAWINGS

These and other objects, features and many of the attendant advantages of this invention will be better understood by those with ordinary skill in the art in connection with the following detailed description of the preferred embodiments and the accompanying drawings wherein.

Like reference characters refer to like parts throughout the several views of the drawings.

DETAILED DESCRIPTION OF THE PREFERRED EMBODIMENTS

Figure 1:
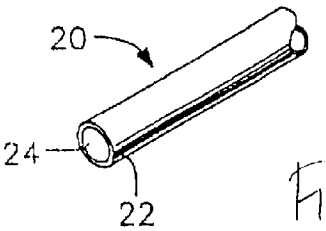
FIG. 1 is an enlarged perspective view of one form of a "sheath-core" bicomponent fiber according to the instant invention.

The instant inventive concepts are embodied in a bicomponent, sheath-core, melt blown, fiber as seen schematically, very enlarged, at 20 in FIG. 1 wherein the core 24 is formed of nylon 6,6 and the sheath 22 is formed of polyethylene terephthalate or a copolymer thereof.

As defined in the '766 patent, the term "bicomponent" as used herein refers to the use of two polymers of different chemical nature placed in discrete portions of a fiber structure. While other forms of bicomponent fibers are possible, the more common techniques produce either "side-by-side" or "sheath-core" relationships between the two polymers. The instant invention is concerned with the production of "sheath-core" bicomponent fibers wherein a sheath of polyethylene terephthalate or a copolymer thereof is spun to completely cover and encompass a core of nylon 6,6 or polybutylene terephthalate, preferably using a "melt blown" fiber process to attenuate the extruded fiber.

As defined in the '766 patent, the term "polyethylene terephthalate or a copolymer thereof" refers to a homopolymer of polyethylene terephthalate or a copolymer thereof having a melting point which is higher than the melting point of the thermoplastic core material in the bicomponent fiber.

Conventional linear polyester used to make fibers is the product of reaction of ethylene glycol (1,2 ethanediol) and terephthalic acid (benezene-para-dicarboxylic acid). Each of these molecules has reactive sites at opposite ends. In this way, the larger molecule resulting from an initial reaction can react again in the same manner, resulting in long chains made of repeated units or "mers". The same polymer is also industrially made with ethylene glycol and dimethyl terephthalate (dimethyl benezene-paradicarboxylate). It is believed that polyethylene terephthalate and its copolymer of a broad range of intrinsic viscosities are useful according to this invention, although those with lower intrinsic viscosities are preferred.

By partially substituting another diol for the ethylene glycol or another diacid for the terephthalic acid, a more irregular "copolymer" is obtained. The same effect is achieved by the substitution of another dimethyl ester for the dimethyl terephthalate. Thus, there is a wide choice of alternative reactants and of levels of substitution.

The deviation from a regularly repeating, linear polymer makes the crystallization more difficult (less rapid) and less complete. This is reflected in a lower and wider melting range. Excessive substitution will result in a totally amorphous polymer which is unacceptable for use in this invention.

As defined in the '766 patent, the term "melt blown" refers to the use of a high pressure gas stream at the exit of a fiber extrusion die to attenuate or thin out the fibers while they are in their molten state. Melt blowing of single polymer component fibers was initiated at the Naval Research Laboratory in 1951. The results of this investigation were published in *Industrial Engineering Chemistry* 48, 1342 (1956). Seven years later, Exxon completed the first large semiworks melt blown unit demonstration. See, for example, Buntin U.S. Pat. Nos. 3,595,245, 3,615,995 and 3,972,759 (the '245, '995 and '759 patents, the subject matters of which are incorporated herein in their entirety by reference) for a comprehensive discussion of the melt-blowing process. Although the average diameter of the bicomponent fibers can vary over a significant range without departing from the instant inventive concepts, fine fibers, on the order of about 10 microns, as produced by conventional melt blowing techniques are particularly useful. Specific apparatus and techniques for producing such fibers are found in the '766 patent.

The term "nylon 6,6" as used herein refers to a polymer of adipic acid and hexamethylene diamine. The nylon 6,6 used was DuPont Zytel 101, unfilled, with a melt viscosity range of 88–124 pascal-seconds.

Figure 2:
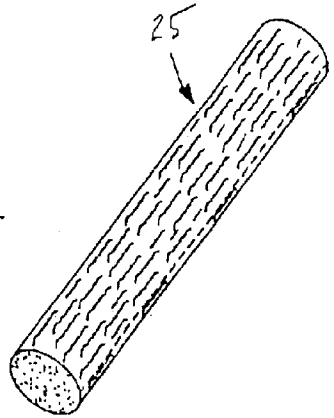
FIG. 2 is a perspective view of an ink reservoir element made therefrom.
Figure 3:
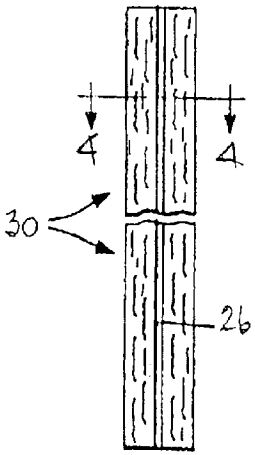
FIG. 3 is a side elevational view of an ink reservoir element including a longitudinally continuous peripheral air passageway integrally formed therein.
Figure 4:
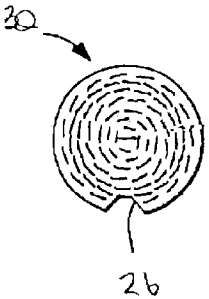
FIG. 4 is an enlarged transverse cross-sectional view taken along lines 4—4 of FIG. 3.

An ink reservoir 25 as seen in FIG. 2 comprises an elongated air-permeable body of fine melt blown bicomponent polyethylene terephthalate/nylon 6,6 fibers such as shown at 20 in FIG. 1, bonded at their contact points to define a high surface area, highly porous, self-sustaining element having excellent capillary properties using the techniques disclosed in the '766 patent. It is to be understood that elements 25 produced in accordance with this invention need not be of uniform construction throughout as illustrated in FIG. 2. For example, a continuous longitudinally extending peripheral groove such as seen at 26 in FIGS. 3 and 4 can be provided as an air passage in an ink reservoir 30, which may or may not include a coating or film wrap (not shown).

Figure 5:
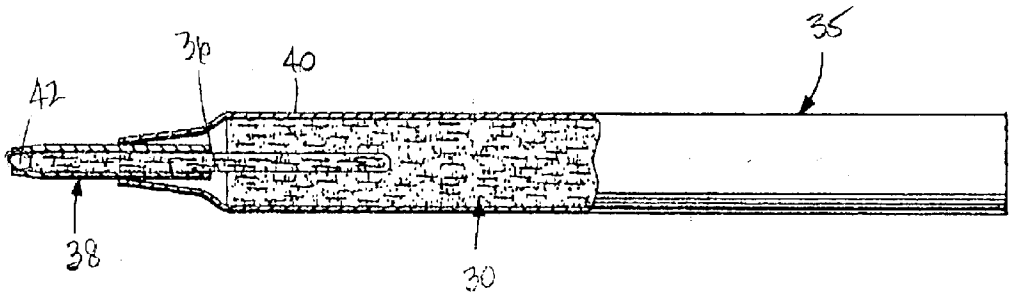
FIG. 5 is a cross-sectional view, partially broken away, of one form of a writing instrument in the nature of a roller ball disposable pen incorporating an ink reservoir, and a roller ball fiber wick made according to the instant inventive concepts.

The reservoir 30 may be incorporated into a writing instrument as shown in FIG. 5 which is illustrated as including a roller ball wick 36, which can also be produced by the techniques of this invention, extending into a roller ball writing tip 38 in a conventional manner. The ink reservoir 35 is contained within a barrel 40 in fluid communication with the roller ball wick 36 to controllably release a quantity of ink retained in the reservoir 30 to the roller ball 42 in the usual way.

As is well known in the art, the roller ball wick 36 will generally have a higher capillarity than the reservoir 30, with the fibers thereof being more longitudinally oriented so as to draw the ink from the reservoir 30 and feed the same to the roller ball 42. It is well within the skill of the art to form the three-dimensions porous elements of the instant invention with higher or lower capillarity depending upon the particular application by controlling, for example, the speed with which the fibrous mass is fed into the forming devices, the size and shape of the forming devices and other such obvious processing parameters.

Figure 7:
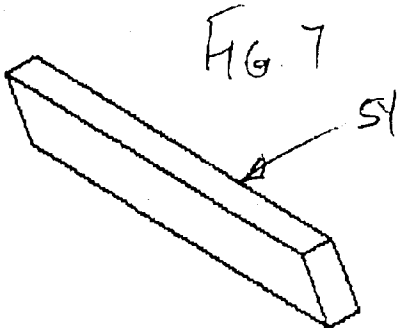
FIG. 7 is a perspective view of the nib portion of the marker of FIG. 6.
Figure 6:
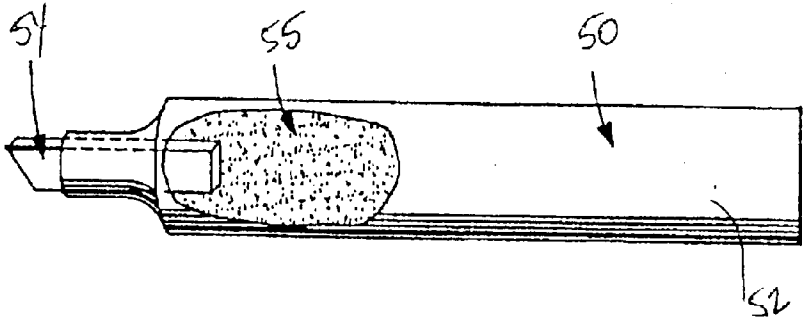
FIG. 6 is a side elevational view, partially broken away, of a marking instrument in the nature of a "felt tip" marker, also incorporating an ink reservoir and a fibrous nib made according to the instant inventive concepts.

In FIG. 6, a masking device is shown generally at 50, as including a conventional barrel 52, containing an ink reservoir 55 in fluid communication with a fibrous wick or nib 54 seen in perspective in FIG. 7, which may be of the type commonly referred to as a "felt tip". Again, the nib 54 is generally denser, than the fibers from which the reservoir 55 are made, in order to provide the nib with the higher capillarity necessary to draw the ink from the reservoir in use.

Figure 8:
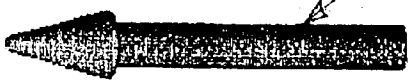
FIG. 8 is a side elevational view of a nib to be used in a fiber-point pen according to this invention.

A fiber tip 60 seen in FIG. 8 can also be provided according to this invention for use in lieu of the roller ball wick 36 of FIG. 5 or the felt tip nib 54 of FIG. 6 in the production of a fiber-point pen in a well known manner.

The angled felt-tip nib 54 and the pointed fiber tip 60 can be provided with the shapes shown, or any other desired shape, by conventional cutting, grinding or other techniques well known to those skilled in the art.

While reference has been made herein to the provision of writing and marking instrument nibs and reservoirs made of melt blown, bicomponent sheath/core polyethylene terephthalate/nylon 6,6 fibers according to this invention, it is to be understood that the nibs of this invention can be used effectively with other reservoirs, even in the presence of aggressive ink formulations, since the reservoirs are not subjected to the pressure experienced by the nibs in use and need not be as robust. Moreover, although polyethylene terephthalate/polybutylene terephthalate ink reservoirs are suggested in the '766 patent, it is surprising that such bicomponent fibers can satisfy the more rigorous requirements of a nib for a writing or marking instrument since the use of the other core polymers referenced in the '766 patent are not acceptable for this purpose as explained below. It will also be understood that reservoirs formed of polyester/nylon 6,6 fibers according to this invention are expected to have advantages, even for use with nibs made of prior art materials.

To compare the properties of nibs made by this invention with nibs made of melt blown bicomponent polyester sheath fibers with different core materials, square stock, angularly cut nibs typical of marker "felt tip" pens, were made from melt blown polyethylene terephthalate (PET)/polypropylene (PP) (25/75) sheath-core bicomponent fibers using the general techniques disclosed in the '766 patent, cut with a razor blade at a 45° angle, and inserted into Sanford Icing Size item number 15000 permanent markers after the commercial nibs were removed. This enabled testing in the exact ink and marker environment. Comparable products were made from melt blown bicomponent fibers comprising PET sheath materials covering, respectively, polybutylene terephthalate (Ticona PBT), nylon (BASF Ultramin) and nylon 6,6 (Dupont Zytel).

All samples spun well, with the PET/PBT and PET/Nylon 6,6 bonding acceptably. PET/Nylon 6 bonding behavior was poorer than the other samples. The PET/nylon 6 nibs were attacked by the ink in a manner similar to PET/PP. Because of this, these pieces were not tested further.

Samples were run at a variety of densities. These densities (all in g/10 pieces) were:

| | |
|---|---|
| PET/PBT: | 5, 6, 7 |
| PET/Nylon 6,6 (melt blown): | 4.5, 5, 6.5 |

For the most part, with the exceptions noted below, the density can be varied over a significant range depending upon the particular application of the final product.

Summary results are:

| Criteria | Store bought | PET/PBT | PET/Nylon 6,6 (melt blown) |
|---|---|---|---|
| 48 softening | Pass | Pass | Pass |
| 48 hour drainback | Pass | Pass (high density (7) failed) | Pass |
| Hand write (will the nib pass ink to paper) | Pass | Pass | Pass |
| Firmness after 48 hours (subjective) | Pass | Pass (some had slightly soft tips) | Pass (some had slightly soft tips) |
| Bleed through | Pass | Pass | Pass |
| Write after 60° C., 5 days | Pass | Pass (except at 7 density) | Pass |
| Firmness after 60°, 5 days | Pass | Slightly feathered | Pass |
| Firmness after 100 meter writing test | Worn down | No impact to feathered | Slightly to heavily feathered |
| Cap off (dryout) test (1 hour in hood) | All fail | Some pass, some fail | Some pass, some fail |

The above tests show that, unlike the PET/PP and PET/nylon 6 samples which were unacceptably softened by the ink and commercially useless as nibs for marking instruments, the PET/nylon 6,6 nibs (as well as the PET/PBT nibs), for the most part, compared favorably with commercial polyester felt/phenolic nibs in each of the tested properties. From a manufacturing standpoint, use of the melt blown process according to this invention enables the creation of finished marker nibs from polymer chip in a continuous manner eliminating the prior art techniques of fiber spinning, felting, forming, resin impregnation and cutting. As a result, significant economies should be achieved, with savings of from 20–50% possible.

Nibs made from the same polymeric components, i.e., PET over nylon 6,6, but of a bonded fiber tow rather than melt blown fibers, fail to provide commercially acceptable drainback properties. Although the rationale for this surprising result is not known for certain, it is theorized that the improved tortuous path characteristics of the melt blown web enhance the drainback properties of the resultant nibs.

The foregoing descriptions and drawings should be considered as illustrative only of the principles of the invention. Numerous applications of the present invention will readily occur to those skilled in the art. Therefore, it is not desired to limit the invention to the preferred embodiments or the exact construction and operation of the preferred apparatus shown and described. Rather, all suitable modifications and equivalents may be resorted to, falling within the scope of the invention.

What is claimed is:

1. A writing or marking instrument comprising a barrel containing a reservoir for holding and controllably releasing a quantity of ink and a nib for transferring ink from said reservoir to a writing surface, said nib comprising a relatively self-sustaining fibrous element formed of a multiplicity of fibers bonded to each other at spaced points of contact to define a porous element, said fibers being melt blown bicomponent sheath/core fiber comprising a sheath of a polymer selected from the group consisting of polyethylene terephthalate and copolymers of polyethylene terephthalate and said core comprising a polymer selected from the group consisting of nylon 6,6 and polybutylene terephthalate.

2. The writing or marking instrument of claim 1, wherein the polymer of said sheath is polyethylene terephthalate.

3. The writing or marking instrument of claim 1, wherein the polymer of said core is nylon 6,6.

4. The writing or marking instrument of claim 1, wherein the polymer of said core is polybutylene terephthalate.

5. The writing or marking instrument of claim 1, wherein the polymer of said sheath is polyethylene terephthalate and the polymer of said core is nylon 6,6.

6. The writing or marking instrument of claim 1, wherein the polymer of said sheath is polyethylene terephthalate and the polymer of said core is polybutylene terephthalate.

* * * * *